US006162128A

United States Patent [19]

McCarty et al.

[11] Patent Number: 6,162,128

[45] Date of Patent: Dec. 19, 2000

[54] BILLIARD/POOL CUE

[75] Inventors: Allan McCarty, Royal Oak; Steve Titus, Whitmore Lake, both of Mich.

[73] Assignee: The Lorraine C. McCarty Trust, Royal Oak, Mich.

[21] Appl. No.: 08/825,249

[22] Filed: Mar. 27, 1997

Related U.S. Application Data

[63] Continuation of application No. 08/314,864, Sep. 29, 1994, Pat. No. 5,725,437.

[51] Int. Cl.[7] ..... A63B 67/00

[52] U.S. Cl. ..... 473/49; 473/44

[58] Field of Search ..... 473/42, 44, 48, 473/49, 51, 564

[56] References Cited

U.S. PATENT DOCUMENTS

| | | | |
|---|---|---|---|
| 132,054 | 10/1872 | Burdock | 473/44 |
| 248,681 | 10/1881 | Walter | 473/49 |
| 258,702 | 5/1882 | Bowne | 473/49 |
| 336,255 | 2/1886 | Nichols | 473/564 |
| 621,787 | 3/1899 | Braun | 473/49 |
| 644,681 | 3/1900 | Page | 473/49 |
| 668,182 | 12/1901 | Heath . | |
| 672,646 | 4/1901 | Mereness | 473/44 |
| 675,313 | 5/1901 | Abbott | 473/49 |
| 723,285 | 3/1903 | Lavey | 473/49 |
| 813,400 | 2/1906 | Buehler . | |
| 818,011 | 3/1906 | Beach | 473/49 |
| 864,943 | 9/1907 | Ajello . | |
| 1,014,502 | 1/1912 | McLaughlin | 473/49 |
| 1,116,827 | 11/1914 | Lee et al. . | |
| 1,139,340 | 5/1915 | Ciarelli | 473/49 |
| 1,147,705 | 7/1915 | Campbell . | |
| 1,257,249 | 2/1918 | Guagiianome | 473/49 |
| 1,457,729 | 6/1923 | Dorschel . | |
| 1,495,842 | 5/1924 | Gulfi . | |
| 1,512,554 | 10/1924 | Magono . | |
| 1,522,321 | 1/1925 | Nyhagen | 473/48 |
| 1,552,442 | 9/1925 | Lund . | |
| 3,103,359 | 9/1963 | Gentile . | |
| 3,226,119 | 12/1965 | Foy | 473/49 |
| 3,410,557 | 11/1968 | Stanley . | |
| 3,695,611 | 10/1972 | Lower . | |

FOREIGN PATENT DOCUMENTS

| | | |
|---|---|---|
| 447513 | 1/1913 | France . |
| 609124 | 8/1926 | France . |
| 785662 | 8/1935 | France . |
| 1028 | 12/1887 | United Kingdom . |
| 13511 | 7/1891 | United Kingdom . |
| 6944 | 2/1892 | United Kingdom . |
| 1367731 | 12/1919 | United Kingdom . |

*Primary Examiner*—Sam Rimell
*Attorney, Agent, or Firm*—Young & Basile, PC

[57] ABSTRACT

A ferrule mounted on one end of a billiard/pool cue shaft has greater compressibility than the compressibility of the shaft to compress on impact of a tip mounted on the ferrule with a ball to absorb a portion of impact forces and to provide easy outward flexure with minimal buckling of the end of the shaft during impact. A bore extends a predetermined distance from the one end of the shaft toward a butt end of the shaft. The bore in the shaft communicates with a bore in the ferrule when the ferrule is mounted on the shaft. The ferrule is mounted on the shaft by means of a tenon formed on one end of the shaft or on the ferrule, which tenon tightly engages the other of the ferrule or shaft. The tip has a smaller than conventional radius to centralize impact forces toward the line of stroke extending along the longitudinal axis of the shaft.

12 Claims, 4 Drawing Sheets

BILLIARD/POOL CUE

This application is a continuation of application Ser. No. 08/314,864, filed on Sep. 29, 1994, now U.S. Pat. No. 5,725,437.

BACKGROUND OF THE INVENTION

1. Field of the Invention

The present invention relates, in general, to billiard/pool cues.

2. Description of the Art

Billiard/pool cues typically are formed of an elongated shaft, a butt at one end of the shaft and a ferrule mounted at an opposite end which supports a tip. The shaft may be formed as a solid, one-piece member or of two threadingly engageable sections. Typically, the shaft is formed of a hard wood, such as a hard maple.

Other materials, such as aluminum, steel, plastic and carbon fiber, have also used to form billiard/pool cue shafts. Cues formed of such "non-wood" materials have been engineered to approximate wood in weight and stiffness or rigidity; however none have proven to play better than a hard wood cue.

It has also been proposed in U.S. Pat. No. 672,646 to form cue shafts of multiple elongated pieces, such as generally pie-shaped sections, which are adhesively joined together to form a generally circular cross section which typically tapers from the butt end to a smaller diameter end supporting the ferrule and tip. In this patent, the grain of each section or strip of wood is disposed so that the dense and porous layers, which naturally alternate with each other, extend between the angled sides of each strip generally parallel to the exterior surface of each strip.

Generally a billiard/pool cue is formed with one of two styles of taper. In an "American" taper, the cue has a constant diameter of approximately 0.5 inches for approximately the first twelve inches from the tip end, this being the longest bridge length commonly used in play. The other common type of taper is a so-called "European taper". In this style of cue, the cue has a truncated cone shape along its entire length tapering to a tip size of approximately 0.35 to 0.45 inches.

Previously devised ferrules have been formed of ivory which is substantially harder than that of the material used to form the shaft. More recently, reinforced phenolics and thermoplastics have been employed to form ferrules. Such ferrules have a modulus of elasticity ranging from a high of $1.3\times10^6$ psi to a low of $0.35\times10^6$ psi as compared to the $1.8\times10^6$ psi modulus of elasticity of hard maple commonly used to form the shaft. The ferrule is adhesively joined to and/or press fit to one end of the shaft, typically by means of a tenon in the form of a narrow diameter end portion which projects out of the end of the shaft into a hollow bore extending inward from one end of the ferrule or, alternately, from the ferrule into a bore in one end of the shaft.

The tip, which is typically formed of leather, is adhesively joined to the ferrule. Generally, the tip, according to popular practice, is formed with a large radius to present a generally flat ball contacting end portion.

In use, the shaft is lined up with the intended path of movement of the cue ball prior to stroking the shaft to impact the tip on the ball. The cue can also be lined up to strike the cue ball off center, that is, to the left or right of the center of the ball, or above or below the center of the ball, to impart spin, draw or follow to the cue ball to cause it to move in a desired direction after it strikes another ball or a rail. However, as a result of a hit to the left or right of center, the cue ball does not follow a path of movement that is parallel to the line of stroke of the cue. Rather, the cue ball deflects or moves in a path at an angle to the line of stroke of the cue. This so-called angle of deflection varies with the speed of the stroke and how far from center the cue tip strikes the cue ball, but with a given off center distance and speed, the magnitude of the angle of deflection is primarily a function of the cue itself.

As shown in FIG. 1, during off center hits, the tip, ferrule and the end of the shaft up to the player's hand bridge initially buckles as shown in phantom due to loading of the impact forces 7 generated during impact of the tip with a cue ball on the inside edge 8 of the shaft closest to the center of the ball. This buckling is then followed by an outward flexing of the tip, ferrule and shaft end. Experimentation by the Applicants has shown that a large amount of buckling results in a larger and more undesirable deflection of the cue ball from a path of movement parallel to the cue stroke line than when buckling is minimized and the end of thie cue more easily flexes or bends outward from the center of the cue ball after impact with the cue ball. FIG. 2A shows the angle of deflection of a cue ball struck to the right of center by a rigid cue. The angles A, B and C are equal to show the same spin angle and velocity. The arrow 1 shows the line of deflection of the ball from the line of stroke of the rigid cue.

In FIG. 2B, the angles A', B' and C' are equal to the angles A, B and C in FIG. 2A to denote the same spin and velocity. However, the cue in FIG. 2B is more flexible than the rigid cue in FIG. 2A. This results in a smaller overall deflection of thle cue ball from the line of stroke of the cue as shown by the arrow 2.

Tests performed by the Applicants' have determined that a hard prior art ferrule is still somewhat softer than the hard maple shaft and provides a measure of compressibility which could lower the angle of deflection of the cue ball. However, this advantage is outweighed by the increased weight of the ferrule as compared to the shaft such that the increased weight at the tip end of the shaft results in substantial deflection of the cue ball. The prior art use of an ABS ferrule appears to the Applicants' to provide a tradeoff between the compressibility of a plastic ferrule and a minimal increased weight; but the angle of deflection of a cue ball struck by such a shaft and ABS ferrule combination is about the same as that of a shaft without a ferrule.

Thus, it would be desirable to provide a billiard/pool cue which minimizes buckling while permitting easier outward flex of the tip end of the shaft to result in less deflection of a cue ball from the line of stroke of the cue shaft. It would also be desirable to provide a billiard/pool cue which has compression features to absorb impact forces generated during the impact of the cue on a ball so as to minimize buckling and permit easier outward flex of the tip end of the cue. It would also be desirable to provide a billiard/pool cue construction which centralizes the impact of the tip with a cue ball toward tlhe longitudinal axis of the shaft during off center hits to lessen buckling and to provide easier outward flex and less deflection of the struck cue ball. It would also be desirable to provide a billiard/pool cue having a lighter tip end so as to provide quick lateral acceleration of the tip end on impact for easier outward flex of the tip end and less deflection of the cue ball.

SUMMARY OF THE INVENTION

The present invention is a billiard/pool cue having a ferrule which provides compression on impact of the tip with a cue ball to absorb a portion of the impact forces so as to permit easy outward flexure of the tip end of the shaft. This compression and outward flexure of the tip end of the shaft minimizes inward buckling of the tip end of the shaft on off center hits and results in less deflection of the cue ball from the line of stroke of the cue.

According to the present invention, a billiard/pool cue includes a shaft having first and second opposed ends. A ferrule is mounted on the first end of the shaft. A tip is mounted on the ferrule. The ferrule has greater compression than the shaft so as to compress on impact of the tip with a cue ball and absorb a portion of the impact forces.

In one embodiment, a bore is formed in the shaft extending longitudinally from the first end on which the ferrule is mounted for a predetermined distance toward the second end of the shaft. The bore has a length less than the length of the shaft.

Preferably, the tip is formed with a smaller radius than used in previously devised tips to form a more rounded contact surface which centralizes impact forces, particularly in the case of an off center hit, toward the longitudinal axis of the shaft so as to minimize inward buckling of the tip end of the shaft.

In another embodiment, a bore is formed in the ferrule extending longitudinally from the end of the ferrule which is mounted on the first end of the shaft. The bore in the ferrule is disposed in communication with the bore in the shaft when the ferrule is mounted on the first end of the shaft.

The ferrule is attached to the first end of the shaft preferably by means of a tenon formed on either the ferrule or the shaft. Preferably, the tenon is formed on the shaft and extends outward from the first end thereof into the bore formed in the ferrule. The bore in the shaft, in this embodiment, extends through the tenon.

The shaft is preferably formed of multiple wood sections constructed from the same piece of wood. Each section is generally pie shaped and is oriented with the grain extending toward the longitudinal axis of the shaft when the sections are joined together. The bore in the shaft can be easily formed by forming a notch on the inner edge of the tip end of each section of the shaft.

The billiard/pool cue of the present invention uniquely provides compression during impact of the cue with a ball to absorb a portion of the impact forces which provides easy outward flexure of the tip from the ball while minimizing inward buckling of the tip, the ferrule and the end portion of the shaft. This results in less deflection of the ball from the longitudinal stroke axis of the shaft. To achieve this compression, the ferrule is formed of a material which is softer or more compressible than the material used to form the shaft. In addition, the tip is formed with a smaller than normal radius to centralize impact forces toward the longitudinal axis of the shaft, particularly in the case of an off center impact with a ball, so as to minimize buckling of the shaft.

The bore formed in the tip end of the shaft also reduces the weight of the tip end thereby resulting in a lighter tip end on the cue shaft which is capable of easier outward flexing than previously devised cue shafts since the tip end can quickly accelerate laterally due to its reduced weight. Further, the bore in the ferrule is aligned with the bore in the shaft to further reduce weight or mass at the tip end of the shaft. The combination of a compressible ferrule with a light tip end results in a cue having better performance in terms of a lessened angle of deflection of a struck cue ball than previously possible using prior art cue constructions.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 3:
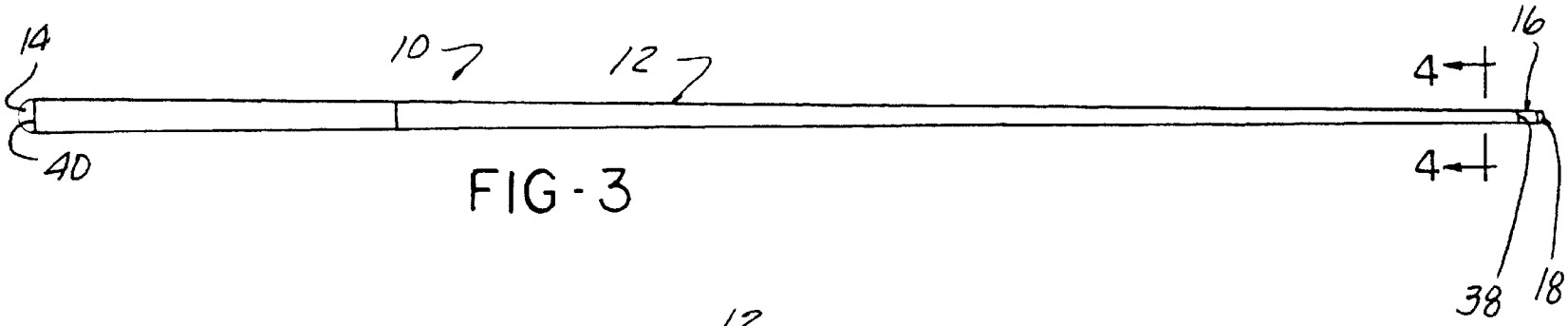
FIG. 3 is a side elevational view of a billiard/pool cue constructed in accordance of the teachings of the present invention.

Referring now to the drawing, and to FIG. 3 in particular, there is depicted a billiard/pool cue 10 constructed in accordance with the teachings of the present invention which has a uniquely designed shaft, ferrule and tip to provide compression during impact of the cue 10 with a ball so as to absorb a portion of impact forces and cause easy outward flexure of the tip end of the shaft with minimal inward buckling which results in a truer tracking of the ball along its intended path of movement with less deflection.

Figure 5:
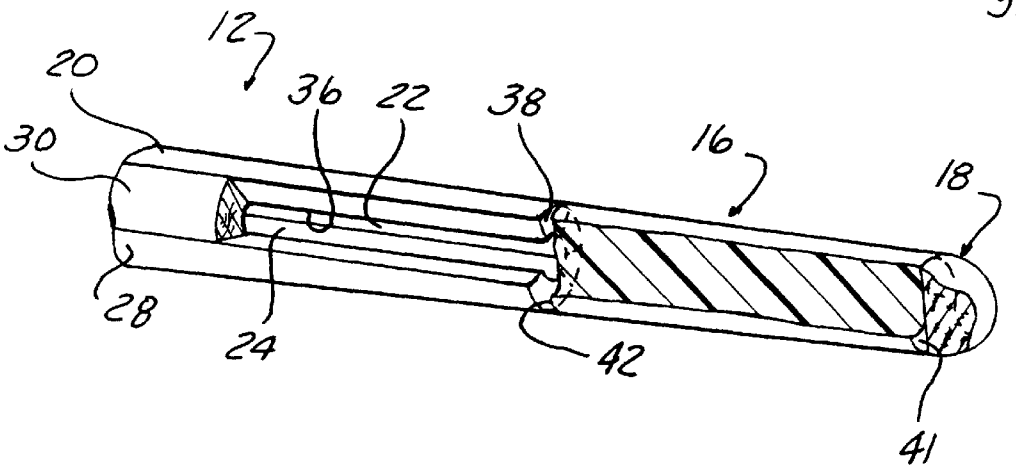
FIG. 5 is a broken away, perspective, partial view of the tip, ferrule and one end of the shaft of the cue shown in FIG. 1.
Figure 4:
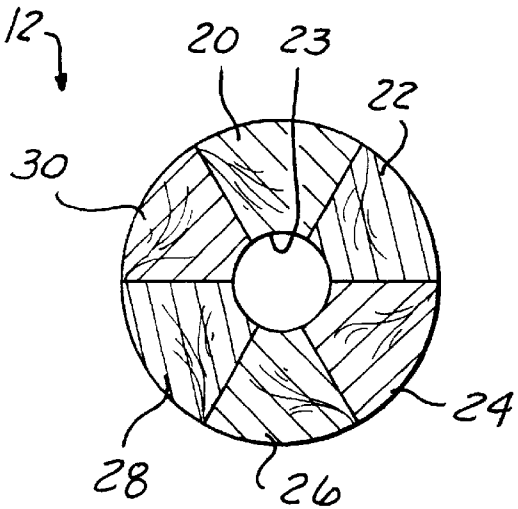
FIG. 4 is a cross sectional view generally taken along line 4—4 in FIG. 3.

As shown in FIGS. 3, 4 and 5, the cue 10 includes a shaft 12, a butt end 14, a ferrule 16 and a tip 18. The shaft 12 may be formed of a single elongated member or two short members which are coaxially threadingly joined together. As is conventional, the shaft 12 may be formed of any suitable hard material, such as wood, i.e., maple, as well as composite materials, such as carbon fiber, etc.

Although the shaft 12 may be formed of a solid cross section, in a preferred embodiment shown in FIG. 4, the shaft 12 of the cue 10 is formed of a plurality of sections 20, 22, 24, 26, 28 and 30 which have a generally pie or sector shape with an arcuate outer surface. Each section 20, 22, 24, 26, 28 and 30 is formed from the same piece of wood. However, in forming the shaft 12, adjacent sections 20, 22, 24, 26, 28 and 30 of the single piece of wood are arranged adjacent sections which were non-adjacent to each other in the original piece of wood. Thus, sections 20 and 26, for example, may have originally been adjacent to each other in the original piece of wood, but are arranged on opposite diametral sides of the assemblied shaft 12. Importantly, the grain in each section 20, 22, 24, 26, 28 and 30 is oriented to extend toward the longitudinal axis or center of the shaft 12 as shown in FIG. 4. This is believed to provide greater strength for the shaft 12.

A bore denoted by reference number 36 as shown in FIG. 5 is formed in the shaft 12 and extends from a first end 38 of the shaft 12 for a predetermined distance toward an opposed second end 40 of the shaft 12, such as for the approximate length of the bridge formed on the player's hand which supports the tip end of the cue during a stroke. The bore 36 terminates at an end spaced from the second end 40 of the shaft 12 and generally closer to the first end 38 of the shaft 12. The function of the bore 36 is to reduce weight at the tip end of the cue 10 to provide greater acceleration of the tip end during impact, as described hereafter. The bore 36 can be formed by means of a notch 23 on the inner edge of each section 20, 22, 24, 26, 28 and 30, which notch 23, when the sections 20, 22, 24, 26, 28 and 30 are joined together, forms a part of the complete bore 36.

The bore 36 is preferably left hollow as shown in FIGS. 4 and 5. Alternately, the bore 36 could be filled with a plug formed of a resilient, lightweight material, such as urethane, for example.

A wood shaft 12 with any style taper, i.e., "American" or "European", can be made lighter while still retaining a requisite amount of rigidity or stiffness by forming a bore 36 having a diameter of 0.25 inches in a 0.50 inch diameter shaft. Such a sized bore 36 removes approximately 25% of the weight of the tip end of the shaft 12 while only decreasing the shaft rigidity by 6%. Tests performed by the Applicants' has found that a bore of 0.25 inches extending for the first five inches from the tip end of an "American" taper shaft 12 removes three grams of wood, but causes a 22% decrease in cue ball deflection angle. Similar results have been obtained with a similar size and length bore in a "European" tapered shaft 12.

In addition to forming the shaft 12 from a hard maple, other materials having a more favorable specific elasticity are also usable. Such materials, such as graphite epoxy composites or fiber reinforced plastics, can as much as eight times stronger per unit weight than hard maple. However, in shafts formed of such synthetic or from partially synthetic materials, the tip end is as heavy or heavier than comparible all wood shafts. Thus, when using such synthetic materials, the bore 36 becomes even more advantageous.

For example, a graphite/epoxy shaft having a modulus of elasticity of $12\times10^6$ psi, a 0.5 inch O.D. tubular form, and a 0.01" wall thickness surrounding the bore 36, has a rigidity approximate that of a corresponding 0.5 inch diameter maple shaft, but is only 15% as heavy as a maple shaft. A shaft formed of carbon/polyester with a modulus of elasticity of $9\times10^6$ psi, a 0.5 inch O.D. tubular shape, and a 0.015 inch wall thickness, has a rigidity approximate that of a 0.5 inch diameter maple shaft and is only 20% as heavy as a maple shaft. Finally, a glass/epoxy, glass/polyester, or a nylon 6 shaft having a modulus of elasticity of $5\times10^6$ psi, a 0.5 inch tubular shaft, and a 0.025 inch wall thickness, has a rigidity approximate that of a maple shaft, but only 37% of the weight of a maple shaft.

As shown in greater detail in FIG. 5, the ferrule 16 has a generally cylindrical shape, with either straight side walls or a slight taper between a smaller diameter first end 40 and an opposed, larger diameter second end 42. The ferrule 16 may be formed of a variety of materials, such as nylon, ABS, urethane, and even wood. The critical characteristic of the material used to form the ferrule 16 is that the material has greater compression in the longitudinal direction than the compressibility of the material used to form the shaft 12. This increased compression enables the ferrule 16 to absorb a portion of the impact forces imposed on the tip end of the shaft on impact with a cue ball and dampens the shock to the shaft 12 to provide outward flexure of the tip end of the cue 10 while minimizing inward buckling of the tip end. This results in less deflection of a ball struck by the cue 10 from a path of movement parallel to the line of stroke of the cue.

In order to lessen the buckling of the tip end of the shaft, the Applicants' have found that a ferrule 16 having a lower modulus of elasticity than that of previously devised ferrules, i.e., $0.35\times10^6$ to $1.3\times10^6$ psi as described above, serves to dampen the shock imposed on the shaft 12 during an off center hit. Other considerations in choosing ferrule material are impact strength, and surface hardness and gloss, which provide resistance to marring, staining, etc.

The Applicants' have found several satisfactory materials for use in forming a ferrule 16 having the compression, impact strength and surface hardness necessary to achieve the desired compression to minimize buckling of the shaft 12 by dampening the shock to the shaft 12 during an off center hit.

Examples of such materials suitable for forming the ferrule 16 include:

CYCOLAC 2800 GPX (General Electric ABS) modulus of elasticity approx. $0.24\times10^6$ psi, and ISOPLAST 101 (Dow Rigid Urethane) modulus of elasticity approx. $0.25\times10^6$ psi The ferrule 16 may be formed as a solid, unitary body as shown in FIG. 5. Alternately, as shown in FIGS. 6–10, the ferrule 16 may be formed with an internal bore 46. Depending on the mounting arrangement used to mount the ferrule 16 on the first end 38 of the shaft 12, the bore 46 in the ferrule 16, or at least a central portion of the bore 46, is disposed in communication with the bore 36 extending from the first end 38 of the shaft 12. This arrangement reduces weight at the tip end of the cue 10 and enables quicker lateral acceleration of the tip end of the cue 10, as described hereafter.

Various mounting arrangements may be employed to mount or attach the ferrule 16 to the first end 38 of the shaft 12. In one embodiment shown in FIG. 6, a tenon 50 is formed on the shaft 12 and extends longitudinally outward from the first end 38 of the shaft 12. The tenon 50 tightly engages the inner surface of the ferrule 16 surrounding the bore 46 in the ferrule 16 in a press fit. Further, the bore 36 in the shaft 12 extends completely through the tenon 50 into the interior of the ferrule 16.

Figures 6, 7, 8, 9, 10:
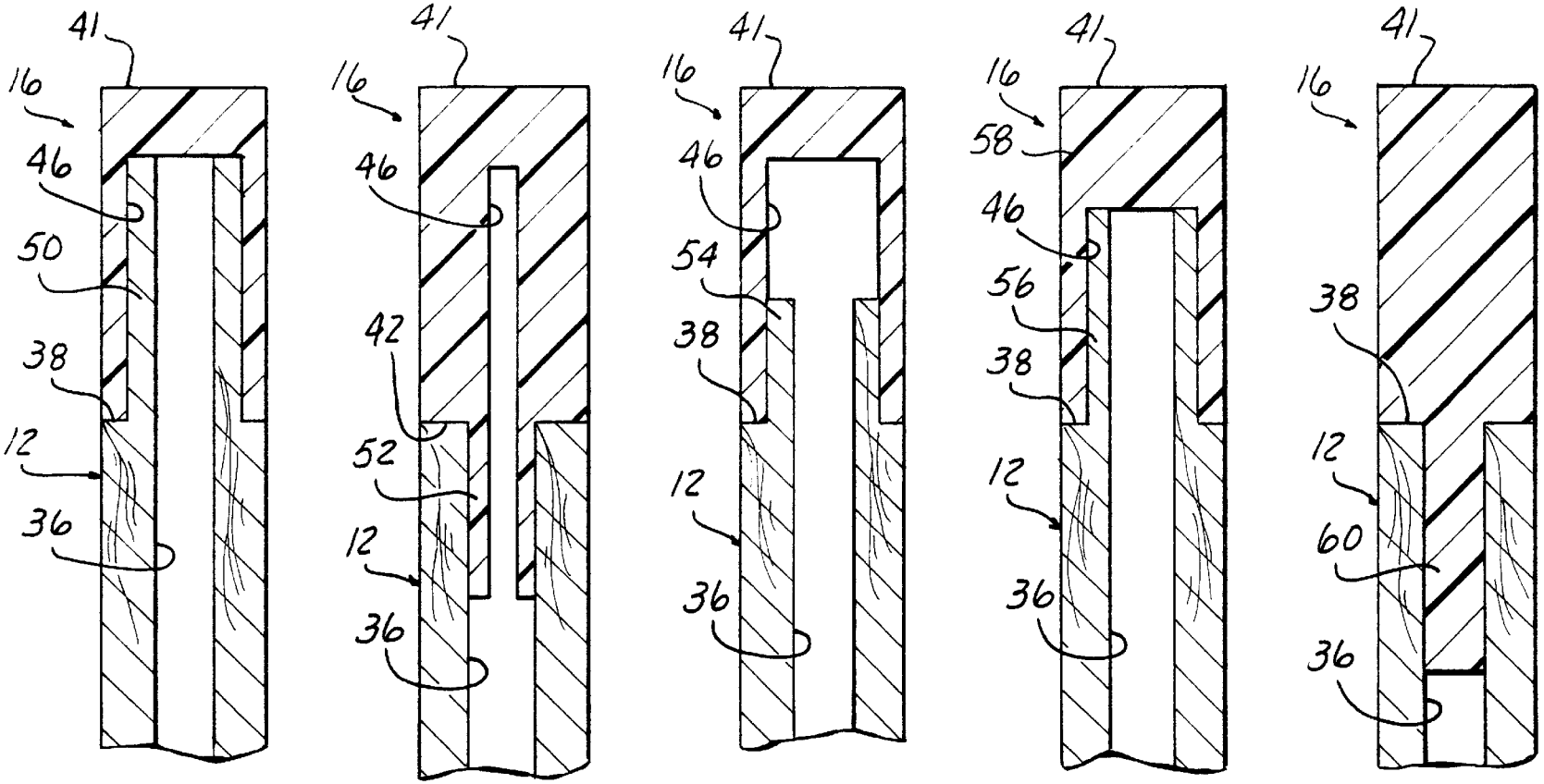
FIGS. 6, 7, 8, 9 and 10 are cross sectional views showing different embodiments for mounting the ferrule on the end of the shaft of the cue shown in FIG. 1.

In another mounting arrangement shown in FIG. 7, a tenon 52 is formed on and extends longitudinally outward from the second end 42 of the ferrule 16. The tenon 52 engages the inner surface of the bore 36 in the shaft 12 adjacent the first end 38 of the shaft 12. In this mounting configuration, the bore 36 in the shaft 12 communicates with the bore 46 in the ferrule 16, with the bore 46 in the ferrule 16 extending completely through the tenon 52.

In the embodiment shown in FIG. 8, a short tenon 54 extends outward from the first end 38 of the shaft 12. The tenon 54 engages the inner surface of the ferrule 16 surrounding the bore 46 in the ferrule 16 for a predetermined distance less than the total length of the bore 46 to leave an enlarged open space in the ferrule 16 between the end of the tenon 54 and a solid end portion of the ferrule 16.

In FIG. 9, a tenon 56 extends outward from the first end 38 of the shaft 12 into the bore 46 in the ferrule 16. In this arrangement, the length of the tenon 56 and the length of the bore 46 are shorter than the corresponding tenon 50 and bore 46 in the mounting configuration shown in FIG. 4 to leave a larger solid end portion 58 adjacent the first end 40 of the ferrule 16.

Finally, in the embodiment shown in FIG. 10, the ferrule 16 is formed without an internal bore. In this embodiment, the ferrule 16 includes an outwardly extending tenon 60 which projects from the second end 42 of the ferrule 16 into the end of the bore 36 in the shaft 12. A portion of the bore 36 in the shaft 12 remains beyond the end of the tenon 60.

The tip 18 is mounted by means of an adhesive to the first end 40 of the ferrule 16. Optionally, a resilient pad 64 shown in FIG. 11 may be interposed between the tip 18 and the first end 40 of the ferrule 16. The resilient pad 64 may be formed of any suitable resilient material, such as urethane, by example only. The pad 64 provides additional resiliency during impact of the tip 18 with a ball and is capable of a slight rocking during such impact.

Figure 11:
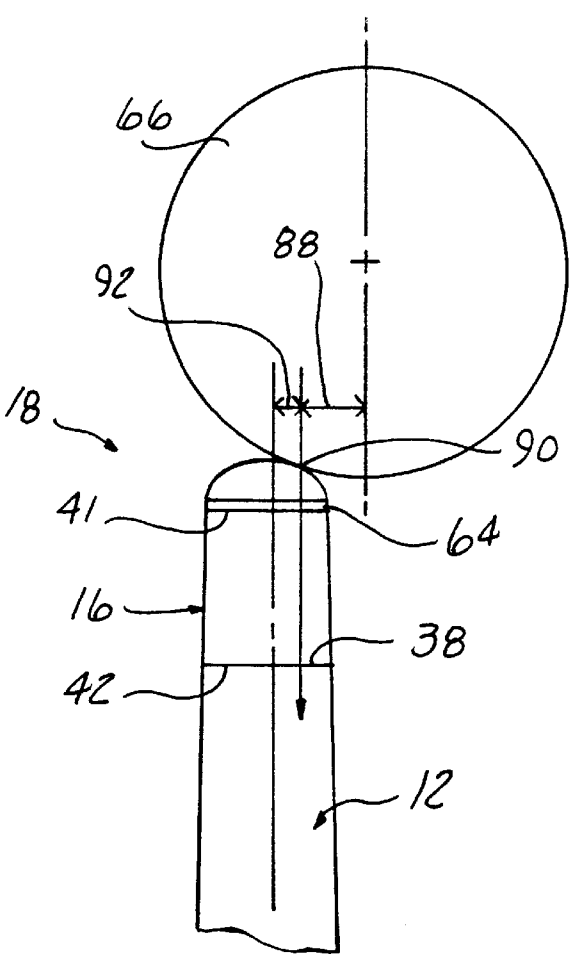
FIG. 11 is an enlarged view of the tip and ferrule of the cue shown in FIG. 3 and showing additional features of the present invention.

In addition, the tip 18 is formed with a smaller than conventional radius as also shown in FIG. 11. The smaller than conventional radius, which may be 8 mm or less, with 7.5 mm being an example only, provides for a more centralized loading of impact forces on the tip 18 toward the longitudinal axis 68 of the shaft 12. This is particularly useful in off center hits on a ball 66 as shown in FIG. 2B to propel the ball 66 with less deflection from the line or stroke of the shaft 12.

Figure 1:
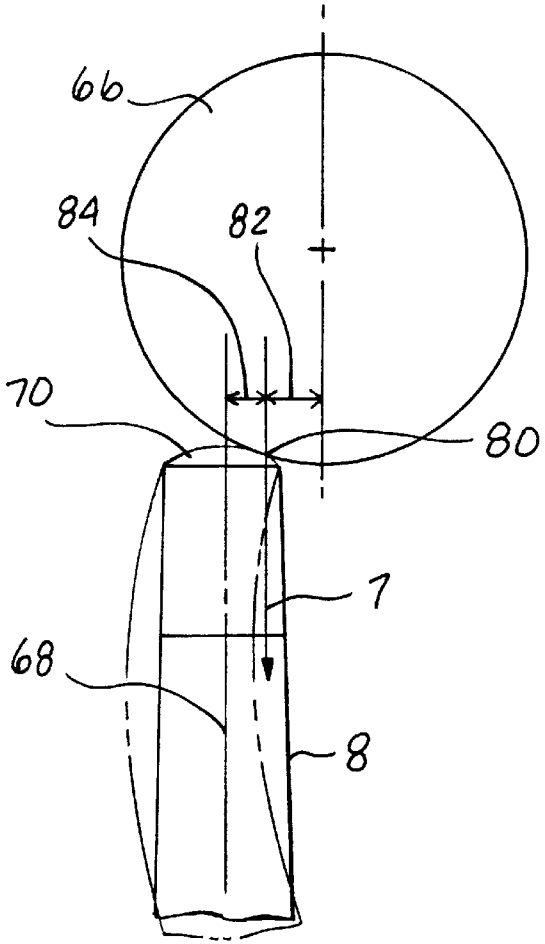
FIG-1 PRIOR ART
FIG. 1 is an enlarged view of a prior art tip and ferrule.

A conventional prior art tip 70, shown in FIG. 1, has a larger radius, i.e. 10 mm or greater, than that of the tip 18 of the present invention. This results in contact of the tip 70 with a ball 66 substantially further radially outward from the longitudinal axis 68 of the shaft than that of tip 18 which results in greater deflection of the ball 66 from a path of motion generally parallel to the line of stroke of the shaft 12.

For example, a conventional tip 70 shown in FIG. 1 with a radius of 10.5 mm on impact with a ball 66 at a point of contact 80 10 mm from the center of the ball 66, as shown by the dimension line 82, will have the point of contact 84 located approximately 4 mm from the longitudinal axis 68 of the shaft. A tip 18 constructed according to the present invention with a radius of 7.5 mm, as shown in FIG. 2B, on contact with a ball 66 10 mm, as shown by reference number 88, from the center of the ball will have the point of contact 90 located only 2.5 mm from the longitudinal axis of the shaft 12, as shown by reference number 92, due to the more rounded shape of the tip 18. This results in the loading forces on the shaft 12 being located closer to the axis of the cue shaft 12 so as to minimize any undesirable buckling of the end of the shaft 12 in the manner shown in FIG. 1.

Figure 2A:
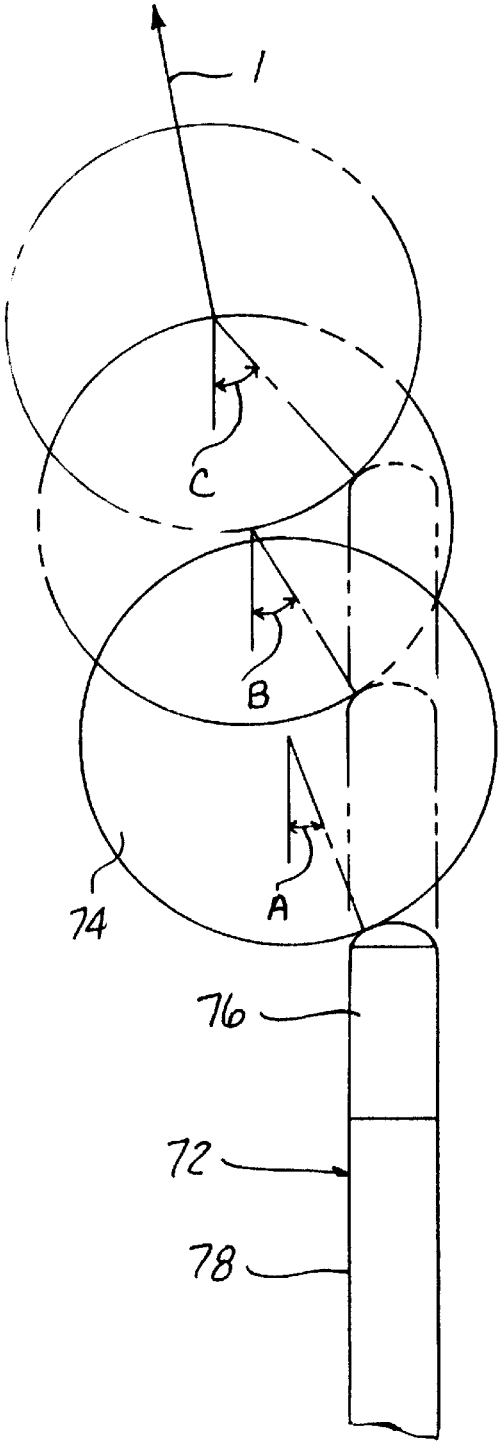
FIG-2A PRIOR ART
FIG. 2A is a pictorial representation showing the impact of a prior art billiard/pool cue on a ball.
Figure 2B:
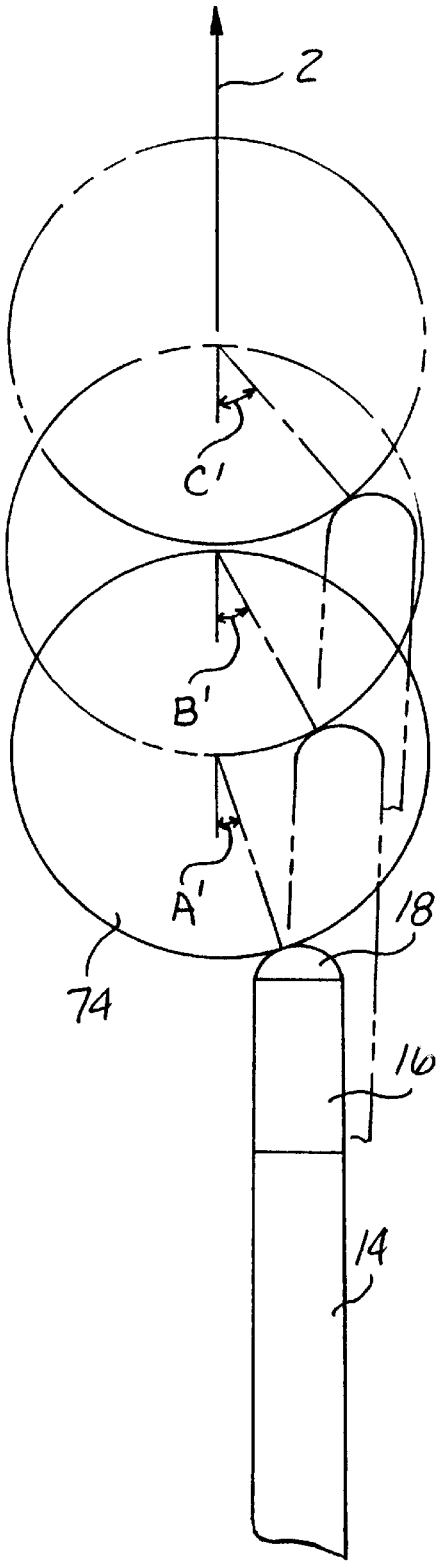
FIG. 2B is a pictorial representation showing the impact of the billiard/pool cue of the present invention on a ball.

The advantages of the cue 10 of the present invention may be more clearly understood by reference to FIGS. 2A and 2B which respectively show the action of a conventional shaft 72 and a shaft 14, ferrule 16 and tip 18 on impact with a ball 74. In a conventional shaft 72, shown in FIG. 2A, the ferrule 76 is formed of a material which is as hard or harder and less compressible than the shaft 72. This prevents any substantial absorption of impact forces generated during impact of the shaft 72 with a ball 74 and causes the tip end of the shaft 72 to buckle further inward as shown in phantom in FIG. 1. This increased buckling results from the impact forces being transmitted generally along the inside edge 78 of the shaft 72 during an off center impact with a ball 74.

FIG. 2B depicts the action of the tip end of the cue 10 of the present invention during impact with a ball 74. Due to the greater flexibility of the tip end of the cue 10 and the compression provided by the ferrule 16 and/or tip 18 of the present invention, as described above, inward buckling of the tip end of the shaft 12, as shown in FIG. 2B, is minimized. The cue 10 of the present invention exhibits easy radially outward flexure, to the positions shown in phantom in FIG. 2B during impact with a ball 74, which results in less deflection of the ball 74 from a line parallel to the line of movement or stroke of the shaft 12.

In summary, there has been disclosed a billiard/pool cue having a unique ferrule, tip and shaft construction which minimizes buckling while permitting easy outward flexing of the tip end of the cue during impact of the cue with a ball to result in less deflection of the ball from a desired path of movement generally parallel to the longitudinal stroke axis of the shaft. The ferrule is formed of a material which has greater compression than the shaft so as to compress and absorb a portion of the impact forces generated during impact of the tip with a ball. This results in a more desirable easy flexure of the tip, the ferrule and the tip end of the shaft radially outward from the ball while minimizing undesirable inward buckling of the tip end. The formation of a hollow bore in the tip end of the shaft and, optionally, in the ferrule, reduces weight or mass at the tip end of the shaft for greater lateral acceleration of the tip end of the shaft, more velocity and impact force, and, further, faster outward flexing of the tip end on impact. Finally, the present cue further minimizes inward buckling on impact by using a more rounded tip having a smaller than conventional radius.

What is claimed is:

1. A billiard/pool cue comprising:

a shaft having first and second opposed ends;

a ferrule mounted on the first end of the shaft; and a zip mounted on the ferrule; and a void hollow bore formed in the shaft extending from the first end of the shaft for a predetermined distance toward the second end of the shaft, the predetermined length of the bore being substantially less than a length of the shaft between the first and second ends to significantly reduce the weight of the shaft only adjacent the first end of the shaft.

2. The billiard/pool cue of claim 1 further comprising:

a hollow bore formed in the ferrule and extending from one end of the ferrule adjacent the first end of the shaft, the hollow bore in the ferrule communicating with the hollow bore in the shaft.

3. The billiard/pool cue of claim 2 further comprising:

a tenon formed on and extending longitudinally outward from the first end of the shaft, the tenon extending into the bore in the ferrule.

4. The billiard/pool cue of claim 2 further comprising:

a tenon formed on and extending longitudinally outward from the ferrule and extending into the bore in the shaft when the ferrule is mounted on the shaft.

5. The billiard/pool cue of claim 1 further comprising:

a resilient pad mounted between the tip and the ferrule.

6. The billiard/pool cue of claim 1 wherein:

the shaft is formed of a plurality of longitudinally extending sections, each section having a grain extending radially toward a longitudinal axis of the shaft when the sections are joined together to form the shaft.

7. The billiard/pool cue of claim 1 further comprising:

the shaft formed of a plurality of joined, longitudinally extending sections, each section having an inner edge, two opposed, angularly spaced side edges extending from the inner edge, and an outer surface, a notch formed on the inner edge of each section extending from the first end of the shaft, the notches of the plurality of sections forming the hollow bore in the shaft when the sections are joined together.

8. The billiard/pool cue of claim 7 wherein:

each section has a grain extending radially toward the inner edge of each section.

9. The billiard/pool cue of claim 1 further comprising:

a tenon formed on and extending longitudinally outward from the first end of the shaft, the tenon extending into the bore in the ferrule.

10. The billiard/pool cue of claim 1 further comprising:

a tenon formed on and extending longitudinally outward from the ferrule and extending into the bore in the shaft when the ferrule is mounted on the shaft.

11. The billiard/pool cue of claim 1 further comprising:

a resilient pad mounted between the tip and the ferrule.

12. The billiard/pool cue of claim 1 wherein the predetermined length of the bore in the shaft is substantially five inches.

* * * * *